United States Patent [19]

Davis

[11] Patent Number: 4,805,570

[45] Date of Patent: Feb. 21, 1989

[54] MULTIPOINT SPARK IGNITION SYSTEM

[75] Inventor: James A. Davis, Ripon, Wis.

[73] Assignee: Brunswick Corporation, Skokie, Ill.

[21] Appl. No.: 137,057

[22] Filed: Dec. 23, 1987

[51] Int. Cl.[4] ..... F02P 1/00; F02P 15/02

[52] U.S. Cl. ..... 123/310; 123/169 EL; 123/169 MG

[58] Field of Search ..... 123/310, 169 MG, 169 EL, 123/169 R, 636, 627, 647, 638; 313/123, 141

[56] References Cited

U.S. PATENT DOCUMENTS

| | | | |
|---|---|---|---|
| 1,556,779 | 10/1925 | Gavlak | 123/169 MG |
| 1,661,405 | 3/1928 | Brolurka | 123/169 MG |
| 1,742,784 | 1/1930 | Rabezzana | 123/169 R |
| 2,106,578 | 1/1938 | Schwartzwalder et al. | 123/169 R |
| 2,904,010 | 9/1959 | Morrison | 123/169 MG |
| 4,087,719 | 5/1978 | Pratt, Jr. | 123/169 MG |
| 4,436,068 | 3/1984 | Nakamura et al. | 123/310 |
| 4,470,392 | 9/1984 | Yoshioraga et al. | 123/310 |
| 4,535,735 | 8/1985 | Yoshioraga et al. | 123/169 MG |

OTHER PUBLICATIONS

SAE Technical Paper Series, "Multipoint Spark Ignition For Lean Combustion", Nakamura et al., Oct. 21–24, 1985.

*Primary Examiner*—Raymond A. Nelli

*Attorney, Agent, or Firm*—Andrus, Sceales, Starke & Sawall

[57] ABSTRACT

A multipoint spark ignition system for an internal combustion engine. The head of each cylinder of the engine is provided with at least three openings, the axes of which intersect within the cylinder. A spark plug is threaded within each opening, and each spark plug includes a single electrode. The inner end of each electrode carries a thin metallic, laterally extending disc, and the peripheral edges of the discs are spaced apart to provide spark gaps. A first spark plug of the series is connected to the ignition coil of the engine, while the electrode of the last spark plug in the series is connected to ground and the electrodes of the intermediate spark plugs are capacitively loaded.

16 Claims, 1 Drawing Sheet

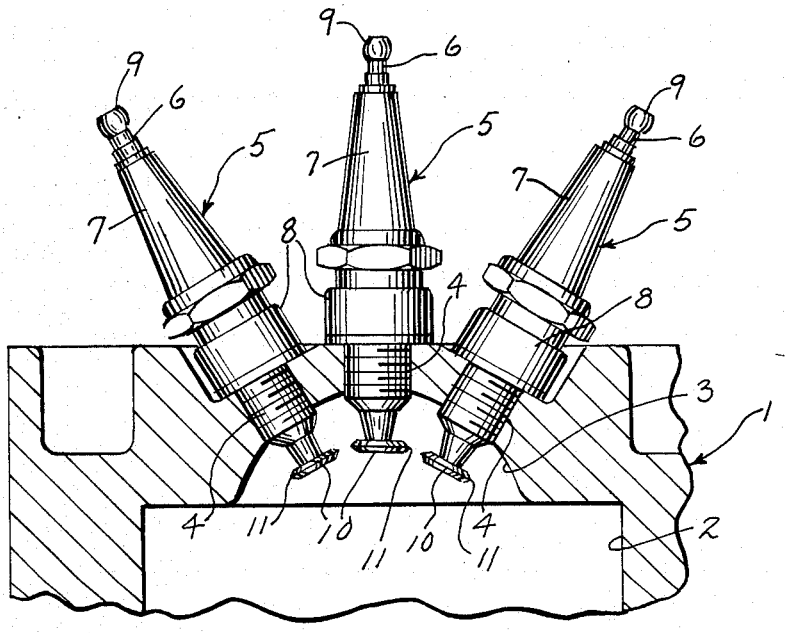
FIG. 1
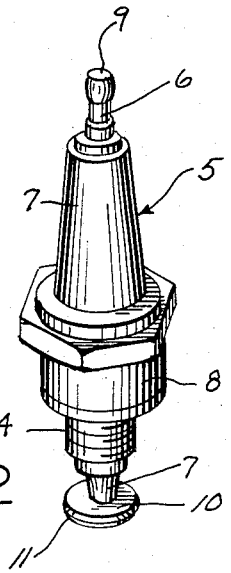
FIG. 2
FIG. 3
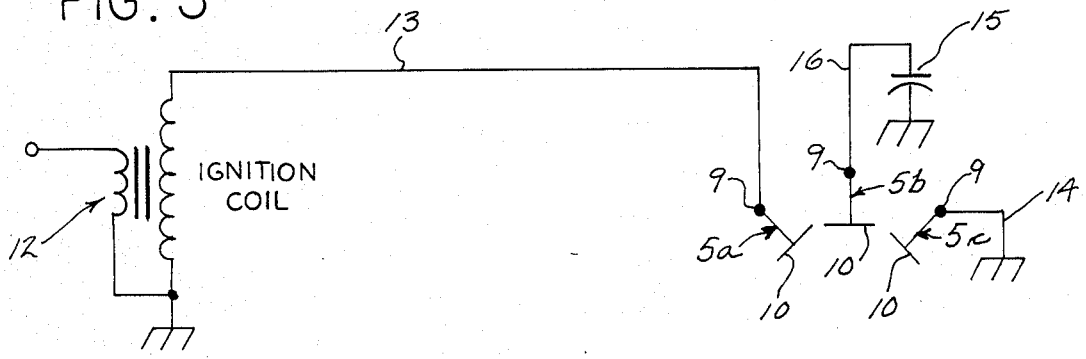
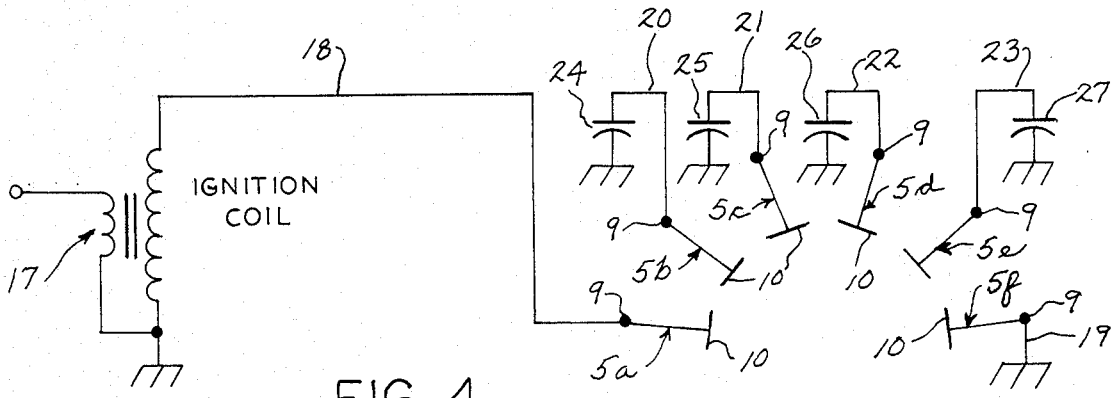
FIG. 4

MULTIPOINT SPARK IGNITION SYSTEM

BACKGROUND OF THE INVENTION

It has been proposed to utilize multiple spark ignition with 4-cycle engines having removable cylinder heads. The use of multiple spark ignition provides a spark of greater duration and is believed to improve the efficiency of combustion. Most engines operate on a constant volume burn, and it is advantageous to ignite the charge at multiple locations.

The physical design of 4-cycle engines with removable cylinder heads allows the multiple spark gaps to be precisely arranged, but it is not possible to apply these concepts to an engine without a removable cylinder head due to the lack of means for establishing, and capacitively loading, the spark gaps within the combustion chamber.

SUMMARY OF THE INVENTION

The invention is directed to a multiple spark ignition system for an engine and has particular application to an engine having fixed cylinder heads. In accordance with the invention, each cylinder head is provided with at least three threaded openings, the axes of which intersect within the combustion chamber.

A spark plug is threaded in each opening and electrically conductive member, preferably in the form of a thin metal disc, is secured to the inner end of each electrode, and the peripheral edges of the discs are spaced apart to provide spark gaps.

The electrode of a first plug in the series is connected to the ignition coil of the engine, while the electrode of the last plug in the series is connected to ground. The electrodes of the intermediate plugs are capacitively loaded, such as by connecting the terminals of the plugs through a capacitor to ground.

The invention has particular application for an engine having fixed cylinder heads, for the discs have a size such that they can be inserted through the threaded openings in the head and by fully threading down the plugs, the proper spark gap is obtained between adjacent discs. Thus the desired spark gaps are achieved without access to the interior of the cylinders.

Other objects and advantages will appear in the course of the following description.

DESCRIPTION OF THE DRAWINGS

The drawings illustrate the best mode presently contemplated of carrying out the invention.

In the drawings:

FIG. 1 is a fragmentary longitudinal section of a cylinder of an internal combustion engine incorporating the multipoint spark system of the invention;

FIG. 2 is a perspective view of a spark plug;

FIG. 3 is a schematic wiring diagram showing the ignition system of the invention utilizing three spark plugs with each cylinder; and FIG. 4 is a view similar to FIG. 3 illustrating an ignition system utilizing six spark plugs per cylinder.

DESCRIPTION OF THE ILLUSTRATED EMBODIMENT

FIG. 1 illustrates a portion of an engine block 1 including a cylinder 2 which is enclosed at its outer end by a dome-shaped head 3. As illustrated, head 3 is integrally formed with cylinder 2. The engine can either be a two or four stroke engine.

Head 3 is formed with at least three threaded openings 4. The axis of each opening is disposed at an acute angle with respect to adjacent axes, and as illustrated, the axes of openings 4 intersect at a point located within cylinder 2. The angularity between the axes of openings 4 depends on the number of openings in the head, and the curvature of the head.

A spark plug 5 is threaded within each opening 4, and each plug includes a single metallic electrode 6 which is surrounded by an electrically insulating casing 7 formed of ceramic material or the like. Plug 5 also has an outer metallic threaded section 8, which is insulated from the elctrode 6 and is threaded within the respective openings 4.

The outer end of each electrode 6 defines a terminal 9, while a thin circular disc 10 formed of an electrically conductive material, such as a copper-nickel alloy, is secured to the inner end of each electrode 6. As shown in FIGS. 1 and 2, the outer periphery of each disc is tapered to a relatively sharp circular edge 11, and the edges 11 are spaced apart to provide spark gaps.

The diameter of the disc 10 is less than the root diameter of the threaded opening 4 so that the disc can be inserted into the cylinder through the opening.

FIG. 3 illustrates the ignition system of the invention utilizing a group of three spark plugs per cylinder. In this system, the secondary of a standard ignition coil 12 is connected through lead 13 to the terminal of the electrode 6 of a first plug 5*a* of the group. The terminal 9 of the last plug 5*c* of the group is connected through lead 14 to ground, while the terminal 9 of the intermediate plug 5*b* of the group is capacitively loaded by connecting capacitor 15 in lead 16 which connects the terminal of plug 5*b* to ground.

FIG. 4 is a schematic representation showing the ignition system of the invention in which six spark plugs are associated with each cylinder. In this system, the secondary of ignition coil 17 is connected by lead 18 to the terminal 9 of electrode 6 of a first plug 5*a* of the series, while the terminal of the last plug of the series, 5*f*, is connected through lead 19 to ground. The intermediate plugs 5*b* through 5*e* are capacitively loaded by connecting the terminal of the respective plugs to ground by the respective leads 20, 21, 22, 23, and a capacitor 24, 25, 26, 27 is connected in each line.

While the drawings have illustrated the intermediate plugs being capacitively loaded by connecting capacitors between the plugs and ground, it is also contemplated that the plugs can be capacitively loaded by incorporating capacitors within the plugs themselves.

The plugs are constructed and designed so that by fully threading down the plugs within the openings 4, the proper gap is obtained between the discs 10. This enables the desired spark gap to be obtained without access to the interior of the cylinders.

While the drawings have shown the electrically conductive members in the form of thin discs 10, it is contemplated that the conductive members can take other configurations, as for example, a bar that extends radially from the inner end of the electrode. However, with the use of a circular disk, the spark gap will be aproximately the same, regardless of the rotational orientation of the plug.

Various modes of carrying out the invention are contemplated as being within the scope of the following claims particularly pointing out and distinctly claiming the subject matter which is regarded as the invention.

I claim:

1. In an internal combustion engine, a cylinder having an end enclosed by a head, said head having at least three openings therein, the axes of the openings being at an angle to each other, a group of spark plugs, each spark plug being mounted in one of said openings, each spark plug having a single electrode with the inner end of each electrode disposed within the cylinder, an electrically conductive member extending laterally from the inner end of each electrode, the periphery of each member being in spaced proximate relation to the periphery of adjacent members to provide a spark gap therebetween, means for connecting the electrode of a first spark plug of said group to the ignition coil of an engine, means for connecting the electrode of the last spark plug of said group to ground, and means for capacitively loading the electrode of an intermediate spark plug in said group.

2. The engine of claim 1, wherein said means for capacitively loading the electrode of said intermediate spark plug comprises means for connecting the electrode through a capacitor to ground.

3. The engine of claim 1, wherein each electricaly conductive member is in the shape of a generally circular disc with the axis of the disc being concentric with the axis of the electrode.

4. The engine of claim 3, wherein the outer periphery of each disc terminates in a relatively sharp edge.

5. The engine of claim 3, wherein each opening is threaded, and each spark plug is provided with an external threaded section engaged with the threaded opening.

6. The engine of claim 5, wherein the diameter of said disc is less than the root diameter of the threaded opening, so that the disc can be inserted through the respective opening on installation of said spark plug.

7. In an internal combustion engine, a cylinder, a head enclosing an end of said cylinder and integrally formed as a one-piece structure with said cylinder, said head having at least three threaded opeings therein with the axes of said openings intersecting within said cylinder, a spark plug threaded in each of said opening, each spark plug having a single electrode with the inner end of said electrode disposed within the cylinder, a thin metallic disc extending laterally from the inner end of each electrode, the peripheral edge of each disc being spaced in proximate relation to the peripheral edge of adjacent discs to provide spark gaps therebetween.

8. The engine of claim 7, and including means for connecting the electrode of a first of said spark plugs to the ignition coil of the engine, means for connecting the electrode of a second of said spark plugs to ground, and means for capacitively loading the electrode of a third of said spark plugs.

9. The engine of claim 8, wherein the diameter of the disc is less than the root diameter of the respective threaded opening.

10. The engine of claim 9, wherein the periphery of each disc terminates in a sharpened edge.

11. The engine of claim 7, wherein said head is integrally formed with said cylinder.

12. The engine of claim 1, wherein said group includes three spark plugs.

13. A spark plug construction for a multipoint ignition system for internal combustion engines, comprising a single electrode having an outer end defining a terminal and having an inner end, an electrically insulated casing disposed around said electrode, mounting means for mounting said spark plug in an opening in the cylinder head of an engine, and an electrically conductive member secured to the inner end of said electrode and projecting laterally from said inner end, said electrically conductive member comprising a generally circular metallic disc.

14. The spark plug of claim 13, wherein the axis of said disc is concentric with the axis of said electrode.

15. The spark plug of claim 13, wherein said mounting means comprises an external thread, and said electrically conductive member comprises a generally circular metallic disc, said disc having a diameter less than the outer diameter of said thread.

16. The spark plug of claim 13, wherein the disc has generally parallel opposed faces and the periphery of said disc terminates in a relatively sharp edge disposed midway between said faces.

* * * * *